United States Patent [19]

Stodden

[11] 4,396,296

[45] Aug. 2, 1983

[54] STOP WATCH

[76] Inventor: Michael F. Stodden, New York, N.Y.

[21] Appl. No.: 317,230

[22] Filed: Nov. 2, 1981

Related U.S. Application Data

[63] Continuation of Ser. No. 941,525, Sep. 11, 1978, abandoned.

[51] Int. Cl.[3] ..... G04F 7/00; G04C 17/00; G04F 10/00

[52] U.S. Cl. ..... 368/101; 368/69; 368/102; 368/309

[58] Field of Search ..... 368/69, 70, 101, 102, 368/103, 104, 105, 106, 113, 276, 309, 93, 185, 278, 294, 281, 191; D10/32, 37

[56] References Cited

U.S. PATENT DOCUMENTS

| | | | |
|---|---|---|---|
| D. 65,351 | 7/1924 | Reichenberg | D10/37 |
| D. 228,939 | 10/1973 | Baunwart | D10/32 |
| 1,431,802 | 10/1922 | Horvath | 368/276 X |
| 2,252,647 | 8/1941 | Schmitz | 368/294 |
| 2,629,981 | 5/1950 | Melik-Minassiantz | 368/281 |
| 2,763,122 | 9/1956 | Hayes | 368/278 |
| 2,788,765 | 4/1957 | Haynes | 368/101 X |
| 3,269,107 | 8/1966 | Morf | 368/191 |
| 3,541,781 | 11/1970 | Bloom | 368/93 |
| 3,557,547 | 1/1971 | Rejminger | 368/101 |
| 3,832,844 | 9/1974 | Matsumura et al. | 368/101 |
| 4,211,066 | 7/1980 | Kusumoto et al. | 368/101 X |
| 4,255,802 | 3/1981 | Ogawa | 368/69 |
| 4,270,197 | 5/1981 | Minowa | 368/102 |
| 4,364,669 | 12/1982 | Thoenig et al. | 368/102 X |

FOREIGN PATENT DOCUMENTS

| | | | |
|---|---|---|---|
| 906970 | of 0000 | France | 368/102 |
| 1085515 | 2/1955 | France | 368/276 X |
| 28565 | of 1904 | United Kingdom | 368/102 |

OTHER PUBLICATIONS

*Runners World* Sep. 1978, pp. 3–4.

*Primary Examiner*—J. V. Truhe
*Assistant Examiner*—Terrance Flower
*Attorney, Agent, or Firm*—Sprung, Horn, Kramer & Woods

[57] ABSTRACT

A stop watch (FIG. 2) for use by runners. A strap is provided and the strap bars 56,57 are disposed at a high level while the back 61 of the watch case is concave or dished. Push-buttons or control pins 17, 18, and 19, for starting, stopping, and resetting the watch, are disposed parallel to the axis of the watch and are actuated by pressing in the axial direction with the finger. These features accommodate strapping the watch to the hand so that the watch fits comfortably in the palm of the hand which is a convenient location when worn by runners.

4 Claims, 9 Drawing Figures

STOP WATCH

This is a continuation of application Ser. No. 941,525, filed Sept. 11, 1978, now abandoned.

BACKGROUND

This invention relates to stop watches, and provides features for stop watches which accommodate wearing of the watch while running. Use by distance runners, e.g. joggers, is particularly contemplated.

The stop watches now commonly used are about two inches in diameter and are designed to be held in the palm of the hand by one other than the runner, such as a coach timing the runner. A sweep second hand and a sweep minute hand are provided and control means are provided for starting and stopping the watch and for resetting the hands to the time zero position. The control means includes push-buttons or control pins which protrude radially from the side of the case. The push-buttons can be moved radially with the fingers to control the operation of the watch, e.g. starting, stopping, and resetting. Stop watches with a digital read-out are also available. A San Francisco, Calif. company, The Sharper Image, has advertised liquid crystal digital stopwatches wherein control is by way of push buttons which are moved axially, i.e. moved in the direction perpendicular to the face of the watch. The advertisements appear in Runner's World, September 1978, pp. 3,4.

It has also been proposed to provide stop watches as are described above with a strap making them wrist watches.

The first mentioned stop watches have the disadvantage that they must be held in the hand by the user. A further disadvantage, if the watch is worn while running, and has radially protruding push buttons or control pins, is that the control pins make holding of the watch uncomfortable and clumsy. The wrist watches also have disadvantages. Thus, conventional stop watches, i.e. those with sweep hands rather than digital readout, are somewhat larger than the usual wrist watches so that the stop watches are bulky for the wrist. Also, when a jacket or the like or gloves are worn, the watch is not readily accessible. Another consideration is that many runners take their pulse immediately following running. If the pulse is taken at the wrist, the watch or the strap may interfere with the pulse measurement.

The objective of the invention is to provide features which particularly facilitate the use of stop watches by runners.

THE INVENTION

The invention is concerned with a stop watch having indicating means for indicating the duration of an elapsed time, such as a time measuring sweep hand or hands and a corresponding scale or such as a digital display, means for driving the indicating means, and control means for control of the drive means for starting and stopping the indicating means and for resetting the indicating means following stopping thereof. The invention provides improvements in such watches.

Thus, the watch can include strap bars to provide for the outfitting of the watch with a strap to facilitate wearing of the watch. A feature of the invention is the disposition of the strap bars at a high level on the watch case, i.e. adjacent or above the watch face, remote from the back of the watch. Desirably, the tops, better, the axes or the bottoms of the strap bars are disposed above the horizontal center line of the watch case, and preferably the tops or even the axes or the bottoms of the bars are at or above the level of the face side of the watch case. This construction is desirable in that it permits strapping the watch to the hand so that the body of the watch rests in the palm of the hand. The face of the watch is of course exposed for viewing. When so worn, the strap extends from one strap bar, around the back of the hand, and then up to the other strap bar. By reason of a high disposition of the strap bars on the watch case, as described above, the strap tends to press the body of the watch into the palm so that the watch fits neatly in the hand. This provides the watch in a convenient location, in a comfortable manner.

A further feature is that the back of the watch can be concave so that the watch fits neatly in the palm of the hand.

Also, according to the invention, the control means can be actuatable for at least one, and preferably all, of the starting, stopping, and resetting by a movement of a finger of a person holding or wearing the watch, in the direction of the axis of the watch. The finger used for the controlling can be a finger of the hand on which the watch is worn. Thus, control pins for controlling the operation of the watch can project axially outwardly from the watch case, and can be actuated with a finger by merely moving the finger axially toward the watch face.

The invention particularly contemplates time indicating means indicating the elapsed time in time units not greater than minutes. Thus the invention does not particularly contemplate time indicating means indicating elapsed hours. However, a digital watch having a mode in which time units not greater than minutes are displayed, and another mode in which say hour intervals are displayed, is within the particular contemplation of the invention.

Embodiments of the invention are described below, in reference to the accompanying drawings.

DESCRIPTION OF DRAWINGS

In the various views, like reference characters indicate corresponding parts.

EMBODIMENTS OF THE DRAWINGS

Figure 1:
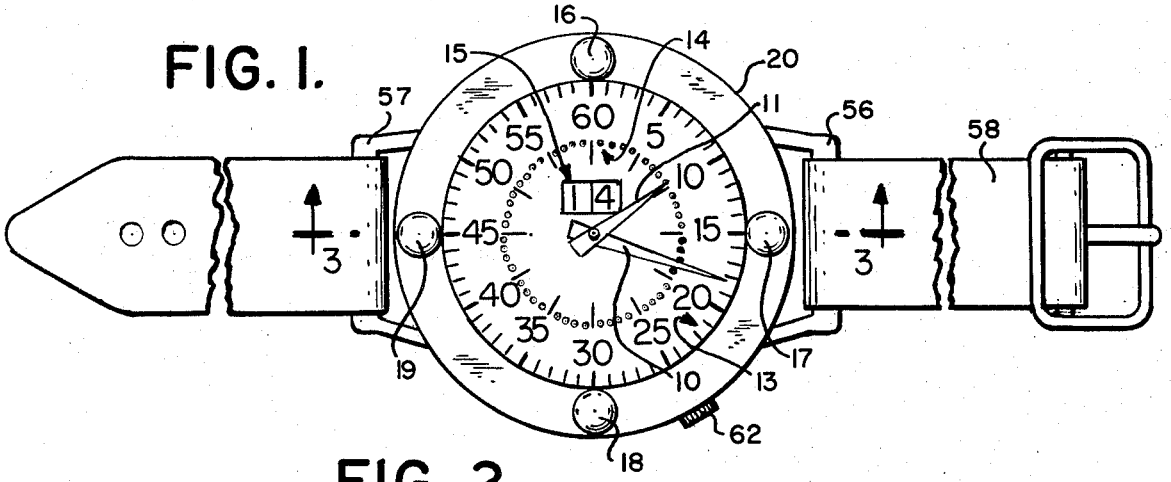
FIGS. 1 and 2, are respectively, a plan view and an elevation view of a watch according to the invention.
Figure 2:
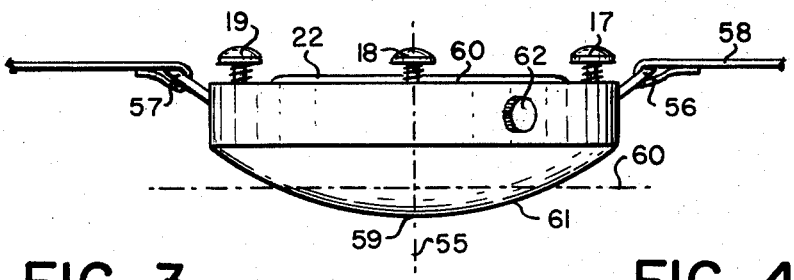
Figure 3:
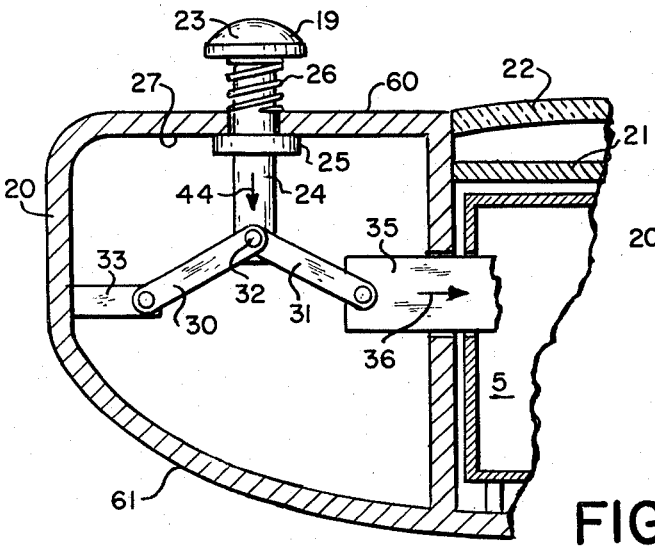
FIGS. 3 and 4, are partial sectional views taken along line 3—3 in FIG. 1, and show, respectively, alternative constructions for facilitating control by an axially directed movement as is described above.

FIGS. 1-3 disclose a stop watch having time measuring sweep hands 10 and 11. Hand 10 is for seconds, and the watch includes a corresponding seconds scale 13. Hand 11 is for minutes, and the watch includes a corresponding minute scale 14. The figures such as 5, 10, etc. between the two scales are for indicating both seconds and minutes. Means for driving the sweep hand or hands is indicated schematically in FIG. 3 by the reference number 5. The watch further includes a lap counter 15.

The operation of the watch is controlled by actuating of push buttons or control pins 16, 17, 18, and 19, which are disposed adjacent the periphery of the watch case 20, projecting from the face side of the case. Control pin 18 is for the starting and stopping of the second and minute hands. Control pin 17 is for resetting the second and minute hands, following stopping, to time zero. Control pin 19 is for actuation of the lap counter 15. Each time the control pin 19 is depressed, the number displayed by the lap counter, is increased by one unit. Control pin 16 is for resetting the lap counter 15 to zero.

The operation of the control pins is shown in FIG. 3. FIG. 3 is a cross sectional view, wherein the watch face 21, and the glass face cover 22 can be seen. The control pin 19 has a head 23, stem 24, and shoulder 25. A spring 26 urges the control pin upwardly so that the shoulder 25 abuts the upper inside surface 27 of the case 20, whereby upward movement of the pin is arrested. At the bottom of the stem 24, an outwardly extending arm 30 and an inwardly extending arm 31 are pivot-mounted by pinion 32. The outer end of arm 30 is pivot-mounted to bracket 33 which is fixedly mounted on the case 20. The end of arm 31 remote from the stem 24 is pivot-mounted on the rod 35. The rod 35 projects into the watch works 5 and, upon actuation thereof, it is effective to control operation of the watch, namely, in the case of control pin 19, the operation of the lap counter 15. Each of the control pins, 16, 17, 18, and 19, can be interconnected with the watch works as is shown in FIG. 3 for control pin 19. Except for the actuation of the control means by an axially directed movement, the control of the watch is conventional. The linkage of the control pins to the control rods such as control rod 35 shown in FIG. 3, is such as to transpose the axially directed movement to a radially directed movement, i.e. a movement in the direction of the arrow 36 shown in FIG. 3. Control of each of the operations of the watch described above by a radial movement is conventional.

If desired, instead of one control pin for starting and stopping the watch, two control pins, one for starting and one for stopping, can be provided. Either construction is conventional and employs radial movement of the control rods for the various operations. The radial movement, according to the invention, can be provided by transposition of an axially directed movement.

Figure 4:
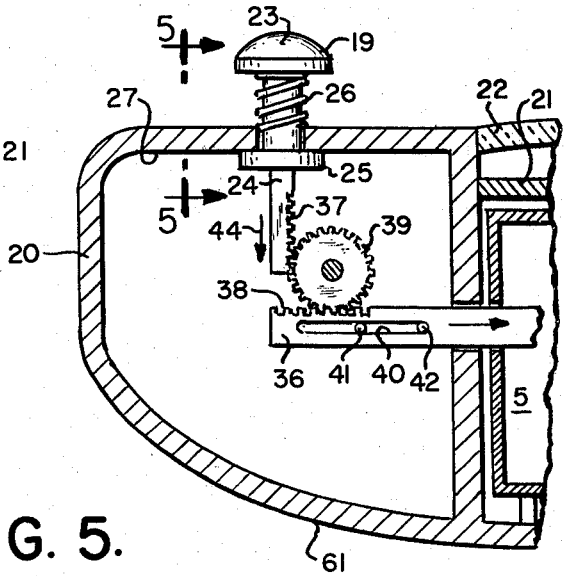
Figure 5:
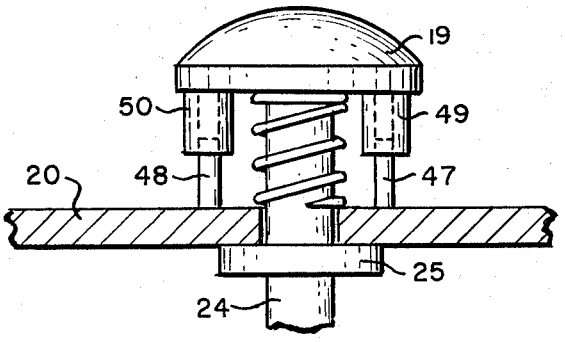
FIG. 5 is a cross sectional view taken along line 5—5 in FIG. 4.

In FIG. 4, an alternative to the linkage shown in FIG. 3, is shown. Thus, the stem 24 and the control rod 36 are, respectively, provided with rack portions 37 and 38, while a pinion 39 is provided. An axially directed movement of the pin 19 in the direction of the arrow 44 will rotate the pinion 39 which cooperates with the rack 38, so that the control rod 36 is moved radially. The control rod 36 is provided with a slot 40, which receives the fixed pins 41 and 42, so as to provide the control rod 36 so that it can be shifted back and forth in response to the operation of the control pin 19. As can be seen in FIG. 5, the watch can include guide pins 47 and 48 which cooperate with the receptacles 49 and 50, so as to guide the control pin up and down along a true path in the axial direction.

By the term "axis of the watch" is meant the axis passing through the center of the watch face, and in the direction of line 55 shown in FIG. 2. By reference to movement in the direction of the axis of the watch is meant movement which at least has a component parallel to the axis of the watch.

The invention particularly contemplates a stop watch outfitted with a strap for facilitating wearing of the watch, especially, the wearing of the watch in the palm of the hand, face up, i.e. exposed. For that purpose, strap bars 56 and 57 are provided, while a strap 58 is also provided. The strap 58 can either be a buckling strap as shown in the drawing, or an endless expandable strap. If desired Velcro can be used in place of a buckle. Desirably, the strap bars are disposed so that at least the tops of the bars are above the horizontal center line of the watch case. By the "horizontal center line of the watch case" is meant the line parallel to the watch face, midway between the bottom 59 and the top 60 of the case, thus, in the embodiment of FIGS. 1 and 2, the line 60. Preferably, the strap bars are disposed so that at least the tops of the bars are at or above the level of the top of the watch case. Thus, in FIG. 2, the bars 56 and 57 are disposed above the top 60 of the watch case.

Further, according to the invention, the back 61 of the watch is concave, as is shown in FIG. 2.

In the embodiment of FIGS. 1 and 2, the winding knob is disposed in a conventional manner at the periphery of the watch case, and is connected with the watch works 5 in a conventional manner.

Figure 6:
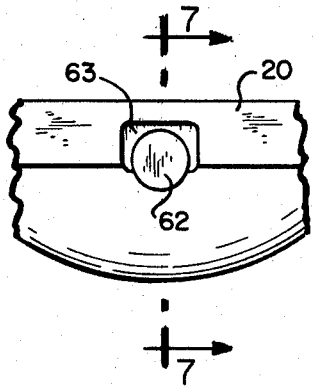
FIGS. 6 and 7 show an alternative construction to that shown in FIGS. 1 and 2 for the location of the watch winding knob, with FIG. 7 being taken along line 7—7 in FIG. 6.
Figure 7:
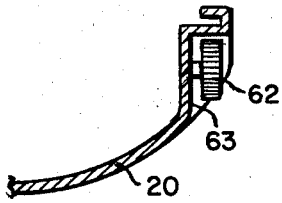

In the embodiment of FIGS. 6 and 7, the winding knob 62 is disposed in a recess 63 in the watch case 20. In this embodiment, the watch can be wound merely by running the finger back and forth while it is pressed against the bottom of the winding knob 62.

Figure 8:
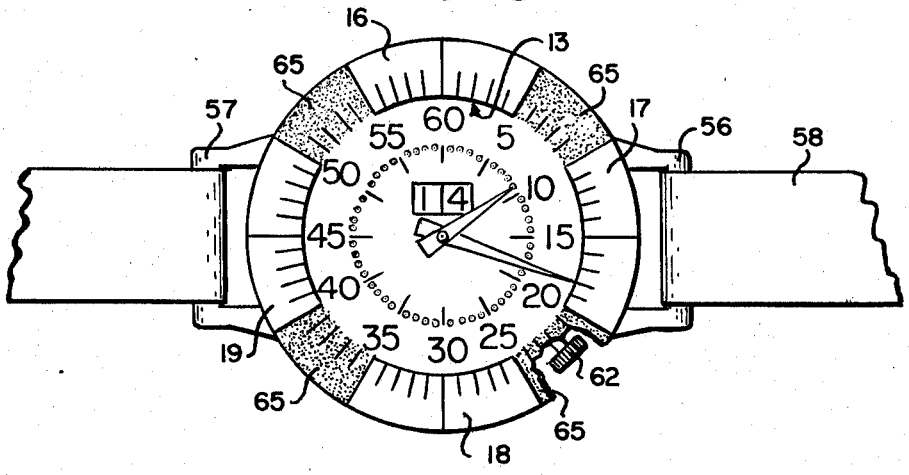
FIGS. 8 and 9, are, respectively, a plan view and an elevation view of an alternative construction.
Figure 9:
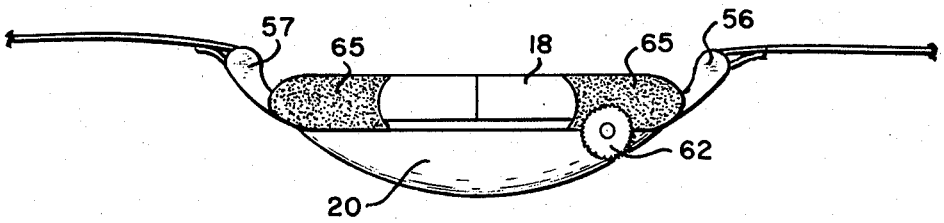

A further embodiment of the watch is shown in FIGS. 8 and 9. In this embodiment the peripheral portion of the watch where the control pins 16–19 are mounted, is designed to have a particularly appealing appearance. In cross section, the contour is that of a part of an oval. In this regard, note FIG. 9. The segments 65 between the control pins are fixed, while, of course, the control pins can be depressed. The segments 65 can be one color, while the control pins are of a different color. In this design the control pins or push buttons do not protrude in a pronounced manner from the peripheral portion of the case, and the peripheral portion has a substantially continuous contour, while the location of the control pins is apparent by reason of contrasting colors between the color of segments 65 and the color of control pins 16, etc.

The winding knob 62 is located on the side of the watch as shown, and does not protrude beyond the outermost part of the watch case so it cannot be seen when viewed from above. As in the embodiment of FIG. 6 and FIG. 7, only the bottom half of the knob will be accessible for winding. Here also, this bottom half access will allow a person to wind the watch by running a finger under the knob.

The watches can be about $1\frac{1}{2}$ to $1\frac{3}{4}$ or more, e.g. 2 or $2\frac{1}{4}$ inches in diameter. The control pins can be actuated with either a finger of the hand in which the watch is held or a finger of the other hand.

While the invention has been illustrated by specific embodiments, those embodiments are merely illustrative of the invention.

What is claimed is:

1. In a stop watch having a case with a substantially planar face, time indicating means disposed in the case and actuatable means for controlling the starting, stopping and resetting of the time indicating means, the improvement wherein: the case comprises a generally convex bottom portion and is configured to be received in the palm of the hand of a user, strap bars disposed not below the plane of the face and a strap connected to the strap bars and configured to extend around the hand of a user to maintain the watch in the user's palm; and the actuatable means comprises push-buttons on the face of the casing and configured to be actuable by the four fingers of the hand of the user in which the watch is strapped in place.

2. The stop watch according to claim 1, wherein the push-buttons are actuatable in response to a force applied normal to the watch face.

3. The stop watch according to claim 1 or 2, wherein the time indicating means includes means for indicating elapsed time in units not greater than minutes.

4. The stop watch according to claim 1 or 2, wherein the actuating means further includes a winding stem and knob and the watch case has a recess in the side thereof to receive the knob to permit access thereto only from the bottom of the watch.

* * * * *